United States Patent [19]

van Vliet

[11] 4,377,771

[45] Mar. 22, 1983

[54] GLOW-DISCHARGE STARTER

[75] Inventor: Johannes A. J. M. van Vliet, Eindhoven, Netherlands

[73] Assignee: U.S. Philips Corporation, New York, N.Y.

[21] Appl. No.: 253,429

[22] Filed: Apr. 13, 1981

[30] Foreign Application Priority Data

May 20, 1980 [NL] Netherlands ..... 8002891

[51] Int. Cl.[3] ..... H01J 7/44

[52] U.S. Cl. ..... 315/047; 315/74; 315/101; 315/119

[58] Field of Search ..... 313/174, 179; 315/47, 315/59, 74, 75, 61, 101, 119

[56] References Cited

U.S. PATENT DOCUMENTS

| | | | |
|---|---|---|---|
| 2,286,789 | 6/1942 | Dench | 315/47 |
| 4,004,171 | 1/1977 | Heuveimans et al. | 313/174 |
| 4,329,621 | 5/1982 | Barakitis et al. | 315/47 |

*Primary Examiner*—Harold A. Dixon

*Attorney, Agent, or Firm*—Robert S. Smith

[57] ABSTRACT

The invention relates to a glow-discharge starter (10) having a bimetallic electrode (11) and a rare gas.

According to the invention the glow-discharge starter also comprises a reversible getter (13) which, when the temperature increases, gives off a gas and, when the temperature decreases, absorbs the gas and the value of the gas pressure also determines the electric conductivity of the glow-discharge starter.

A glow-discharge starter is thereby obtained in which undesired breakdown of the glow-discharge starter can be prevented by controlling the gettering temperature.

6 Claims, 2 Drawing Figures

GLOW-DISCHARGE STARTER

Figure 1:
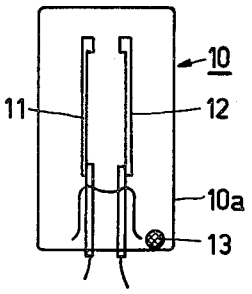

The invention relates to a glow-discharge starter having a bimetallic electrode and a counter electrode and at least a rare gas. The invention furthermore relates to a discharge lamp having a glow-discharge starter according to the invention.

Such a glow-discharge starter is known, for example, from Netherlands Patent Application 7217635. The known glow-discharge starter is used, for example, for starting discharge lamps having two main electrodes. As a rule the glow-discharge starter is placed in a connection which connects one main electrode to the second main electrode. In practice the problem exists that, after starting of the lamps, breakdown may occur in the glow-discharge starter, for example as a result of reignition voltage peaks of the lamp. It is the object of the invention to provide a measure to solve the said problem.

According to the invention a glow-discharge starter of the kind mentioned in the opening paragraph is characterized in that the glow-discharge starter comprises a reversible getter which, when the temperature increases, gives off a gas and which, when the temperature decreases, absorbs said gas, and an increase of the pressure of said gas results in a smaller electric conductivity of the glow-discharge starter.

The advantage of the glow-discharge starter according to the invention is that undesired breakdown of the glow-discharge starter can be prevented by controlling the temperature of the getter.

A switch having a reversible getter is known per se from Netherlands Patent Application 7604759, which getter gives off a gas when the temperature rises and absorbs the gas when the temperature drops and the value of the gas pressure also determines the electric conductivity of the switch. In this known switch, the switch also serves as a starter. It has been found that the starting pulses which are obtained with such a switch have only a restricted voltage value, which is disadvantageous.

It is known per se, to prevent undesired breakdown of a glow-discharge starter, to connect it in series with a bimetal switch, for example, from Netherlands Patent Application 7704134. However, the assembly of such a bimetal switch is cumbersome and expensive.

The gas may be, for example, a multi-atomic gas of which it is known that such a gas has a breakdown voltage-increasing effect in the case of sufficient addition. The gas is preferably hydrogen. This is associated with the advantage that it has small atomic dimensions so that in comparable circumstances it reacts more rapidly than gases having larger atomic dimensions.

A material which has a comparatively large level pressure area over a comparatively large temperature interval can advantageously be used as a getter. Level pressure area is to be understood to mean herein the property that in a range of different composition ratios of getter and absorbed gas, a constant pressure of the gas prevails at a constant temperature. A getter which mainly comprises HfCo shows these advantageous properties to a high extent.

A glow-discharge starter according to the invention may comprise two bimetallic electrodes which are placed at a sufficiently large mutual distance that they just do not contact each other at a desired high gettering temperature. The counter electrode of a glow-discharge starter according to the invention is preferably also constructed as a bimetallic electrode and the bimetallic electrodes, over a given temperature change, have substantially the same bending value and direction and the thermal capacity of one bimetallic electrode is larger than the thermal capacity of the other bimetallic electrode. Herewith it is achieved advantageously that in the conductive state of the glow-discharge starter the bimetallic electrodes will contact each other and that at high gettering temperature required for the unconductive state of the glow-discharge starter the bimetallic electrodes do not make mutual contact.

A glow-discharge starter having bimetallic electrodes according to such a construction is known per se from French patent specification No. 950,825. In the case of that known glow-discharge starter, however, there is no question of a reversible getter. The rare gas maintaining the glow discharge hence determines the breakdown voltage of said known glow-discharge starter. However, said breakdown voltage may be lower than the desired breakdown voltage.

A glow-discharge starter according to the invention may be used for starting a discharge lamp, which lamp comprises a discharge path between two main electrodes. In a preferred embodiment of a discharge lamp comprising a glow-discharge starter in accordance with the invention the glow-discharge starter is in such thermal contact with the discharge path that during operation of the lamp the gas pressure in the glow-discharge starter assumes a value at which the breakdown voltage of the glow-discharge starter is larger than the peak value of the lamp voltage. This advantageous embodiment has for its advantage that a separate provision of control the gettering temperature may be omitted.

Peak value of the lamp voltage is to be understood to mean herein the maximum instantaneous voltage difference during operation of the lamp between the main electrodes.

In an advantageous embodiment of the lamp in accordance with the invention the lamp is a high pressure sodium vapour discharge lamp. Herewith a compact lamp with a large specific luminous efficiency is obtained in an advantageous manner in which in spite of comparatively high reignition peaks no breakdown of the glow-discharge starter takes place during operation of the lamp so that substantially no radio interference occurs.

Figure 2:
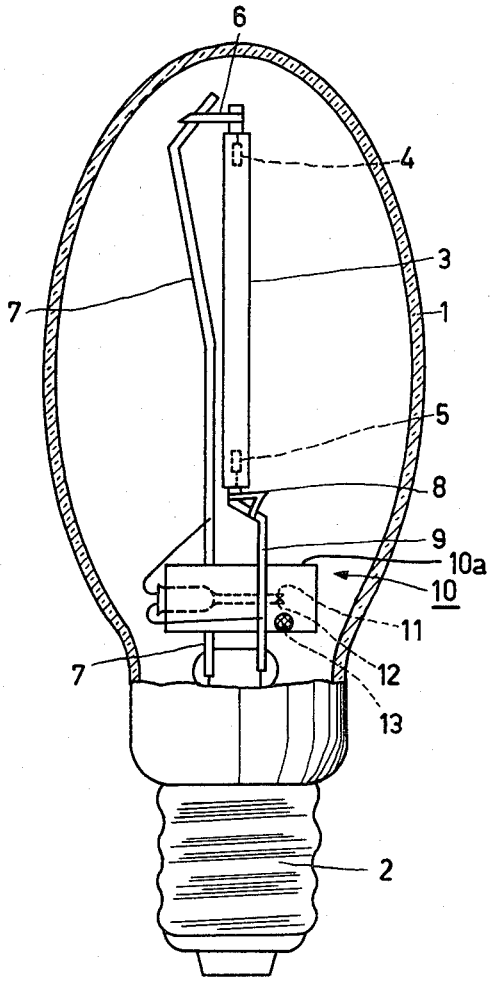

The invention will be described in greater detail with reference to a drawing in which FIG. 1 is a sectional view of a glow-discharge starter according to the invention, FIG. 2 shows a high-pressure sodium vapour discharge lamp having a glow-discharge starter according to the invention.

The glow discharge starter 10 shown in FIG. 1 comprises a glass envelope 10*a* within which two bimetallic electrodes 11 and 12 are present. These bimetallic electrodes are oriented so that they show substantially the same bending direction and value over a given temperature variation. The bimetallic electrodes 11 and 12 have substantially the same length but the cross-section of one bimetallic electrode is considerably smaller than that of the other bimetallic electrode. It is thereby achieved that one bimetallic electrode has a thermal capacity which is larger than the thermal capacity of the other bimetallic electrode. This results in unequal bending velocities during normal operation of the glow-discharge starter; so that the faster bimetallic electrode then overtakes the slower bimetallic electrode. 13 denotes a reversible getter in the form of a pellet having a weight of 50 mg and consisting if HfCo in a composition ratio of 1 atom H per molecule HfCo. The glow-discharge starter furthermore comprises a He-Ar gas mixture for maintaining the glow discharge.

The lamp shown in FIG. 2 has an outer envelope 1 sealed at one end by a lamp cap 2 having an Edison cap. Within the outer envelope is present a discharge vessel 3 having two internal main electrodes 4, 5 between which the discharge path extends. The end of the discharge vessel 3 remote from the lamp cap is connected to a rigid supply conductor 7 via a metal strip 6. Said supply conductor leads to a connection member of lamp cap 2. The other end of the discharge vessel 3 is also connected to a supply conductor 9 via a metal strip 8 which leads to another connection member of lamp cap 2. 10 denotes a glow-discharge starter which has a glass envelope 10*a*.

The construction of the glow-discharge starter 10 corresponds to the glow-discharge starter shown in FIG. 1; corresponding components are referred to by the same reference numerals. One of the two bimetallic electrodes 11 and 12 is connected to the supply conductor 7 and the other bimetallic electrode is connected to the supply conductor 9.

The glow-discharge starter also comprises a reversible getter in the form of a pellet 13 having a weight of 50 mg and consisting of HfCo with a composition ratio of 1 atom H per molecule HfCo. The rare gas filling of the glow discharge starter consists of a He-Ar mixture for maintaining the glow discharge. At room temperature (approximately 300 K) the partial hydrogen pressure is approximately 2 Pa. At 460 K the partial hydrogen pressure is approximately 8 kPa.

The lamp described is operated, for example, via an inductive stabilisation ballast of approximately 0.6 H on an alternating voltage source of 220 Volts, 50 Hz, in which the lamp dissipates a power of 70 W. In the starting condition of the lamp, that is to say a temperature of approximately 300 K, the breakdown voltage of the glow-discharge starter is approximately 125 V and the glow-discharge starter provides starting pulses of approximately 1.7 kV. During operation of the lamp the lamp voltage is on an average approximately 90 V and the reignition peaks occurring in the lamp voltage have a value of approximately 150 V. The glow-discharge starter is in such a thermal contact with the discharge path that in the operating condition of the lamp the glow-discharge starter has a temperature of approximately 453° K.; the partial hydrogen pressure is approximately 8 kPa and the breakdown voltage of the glow-discharge starter is approximately 300 V. In the operating condition of the lamp the breakdown voltage of the glow-discharge starter therefore is larger than the reignition peaks in the lamp voltage.

What is claimed is:

1. A glow-discharge starter comprising a bimetallic electrode and a counter electrode and at least a rare gas, characterized in that the glow-discharge starter comprises a reversible getter which, when the temperature increases, gives off a gas and, when the temperature decreases, absorbs said gas and an increase of the pressure of said gas results in a smaller electric conductivity of the glow-discharge starter.

2. A glow-discharge starter as claimed in claim 1, characterized in that the gas is hydrogen gas.

3. A glow-discharge starter as claimed in claim 1 or 2, characterized in that the getter comprises substantially HfCo.

4. A glow-discharge starter as claimed in claim 1, 2 or 3, characterized in that the counter electrode is also constructed as a bimetallic electrode and the bimetallic electrodes, with an occurred temperature variation, have substantially the same bending value and direction and the thermal capacity of one bimetallic electrode is larger than the thermal capacity of the other bimetallic electrode.

5. A discharge lamp comprising a glow-discharge starter as claimed in any of the preceding claims, characterized in that the discharge lamp comprises a discharge path between two main electrodes and the glow-discharge starter is in such thermal contact with said discharge path that during operation of the lamp the gas pressure in the glow-discharge starter assumes a value at which the breakdown voltage of the glow-discharge starter is larger than the peak value of the lamp voltage.

6. A discharge lamp as claimed in claim 5, characterized in that the lamp is a high-pressure sodium vapour discharge lamp.

* * * * *